US007802526B2

(12) United States Patent
Brady et al.

(10) Patent No.: US 7,802,526 B2
(45) Date of Patent: Sep. 28, 2010

(54) MODULAR AND CUSTOMIZABLE RETURNABLE RACK SYSTEM

(75) Inventors: Terence H. Brady, Kingston, OH (US); James W. Dayton, Hendersonville, TN (US); Douglas H. Hehn, Snohomish, WA (US); Daniel S. Mullen, Waverly, OH (US)

(73) Assignee: PACCAR Inc, Bellevue, WA (US)

( * ) Notice: Subject to any disclaimer, the term of this patent is extended or adjusted under 35 U.S.C. 154(b) by 537 days.

(21) Appl. No.: 11/682,220

(22) Filed: Mar. 5, 2007

(65) Prior Publication Data

US 2008/0217276 A1 Sep. 11, 2008

(51) Int. Cl.
*B65D 19/00* (2006.01)

(52) U.S. Cl. ..... 108/53.5; 108/55.1; 220/1.5

(58) Field of Classification Search ..... 211/41.1, 211/41.14, 60.1, 85.8, 175, 181.1, 187, 194, 211/195, 189; 108/53.1, 53.5, 55.1, 57.29; 206/448, 386; 220/6, 600, 668; 410/35
See application file for complete search history.

(56) References Cited

U.S. PATENT DOCUMENTS 1,759,645 A * 5/1930 Janke et al. ..... 211/194
2,046,095 A * 6/1936 Shaw ..... 211/85.17
2,542,563 A * 2/1951 O'Neill ..... 206/320
2,699,911 A * 1/1955 Chase et al. ..... 108/53.5
2,700,520 A 1/1955 Skubic
2,775,360 A 12/1956 Phillips
2,863,566 A * 12/1958 White et al. ..... 211/41.14
2,956,763 A 10/1960 D'arca
2,998,141 A * 8/1961 Moore et al. ..... 211/41.14
3,147,860 A * 9/1964 Kean, Sr. et al. ..... 206/448
3,193,093 A * 7/1965 Hansen ..... 206/451
3,195,481 A 7/1965 Verguin
3,327,654 A * 6/1967 Duncan et al. ..... 108/53.1
3,400,671 A 9/1968 Erismann
3,402,845 A * 9/1968 Eriksson ..... 220/1.5
3,499,398 A 3/1970 Murray
3,557,855 A * 1/1971 Weingarten et al. ..... 206/386
3,565,018 A 2/1971 Jay
3,568,608 A 3/1971 Taylor
3,620,388 A 11/1971 Mansson
3,664,273 A 5/1972 Howe
3,665,869 A 5/1972 Howe
3,735,713 A * 5/1973 Glassmeyer ..... 108/53.5
3,804,033 A 4/1974 Izawa
3,809,234 A * 5/1974 Kurick ..... 206/448
3,857,494 A * 12/1974 Giardini ..... 211/194
3,865,250 A 2/1975 Jay
3,946,876 A * 3/1976 Jay ..... 211/60.1
3,994,241 A 11/1976 Evans (Continued)

*Primary Examiner*—Darnell M Jayne
*Assistant Examiner*—Joshua Rodden
(74) *Attorney, Agent, or Firm*—Christensen O'Connor Johnson Kindness PLLC

(57) ABSTRACT

A customizable returnable rack system for shipping products is provided. The system includes a plurality of racks (10), wherein each rack (10) is selectively displaceable between a collapsed position and an upright position. The racks (10) are adapted to be stacked upon one another in either the collapsed or upright position. The system further includes a first removable dunnage structure (22) couplable to a rack (10) and configured to receive a first type of product and a second removable dunnage structure (22) couplable to a rack (10) and configured to receive a second type of product.

7 Claims, 5 Drawing Sheets

U.S. PATENT DOCUMENTS 3,998,169 A 12/1976 Koch
4,098,409 A * 7/1978 Massey ..... 211/195
4,099,640 A * 7/1978 Nessfield et al. ..... 220/6
4,131,071 A * 12/1978 Glassmeyer ..... 108/53.1
4,162,737 A * 7/1979 Clive-Smith ..... 220/1.5
4,186,841 A 2/1980 Buckley
4,290,370 A 9/1981 Gallagher
4,406,366 A * 9/1983 Forshee ..... 206/319
4,591,065 A * 5/1986 Foy ..... 220/7
4,638,744 A * 1/1987 Clive-Smith ..... 108/56.1
4,662,532 A * 5/1987 Anderson et al. ..... 220/7
4,673,092 A 6/1987 Lamson
4,699,280 A * 10/1987 Hoss ..... 211/195
4,735,310 A * 4/1988 Lemery et al. ..... 206/319
4,735,330 A * 4/1988 Hoss ..... 220/6
4,966,085 A 10/1990 Howe
4,976,092 A * 12/1990 Shuert ..... 53/475
4,978,014 A * 12/1990 Humitz et al. ..... 211/195
5,076,457 A * 12/1991 Marovskis ..... 220/6
5,141,114 A * 8/1992 Cate et al. ..... 211/85.8
5,154,286 A * 10/1992 Gits ..... 206/386
5,169,011 A * 12/1992 Ebeling et al. ..... 211/195
5,228,821 A * 7/1993 Gleffe et al. ..... 414/403
5,292,012 A * 3/1994 Davis et al. ..... 211/85.18
5,326,204 A * 7/1994 Carlson et al. ..... 410/143
5,345,879 A * 9/1994 Maillard ..... 108/53.1
5,379,904 A * 1/1995 Brown ..... 211/85.8
5,388,532 A * 2/1995 Wakano ..... 108/55.1
5,415,311 A * 5/1995 Coogan ..... 220/6
5,439,152 A * 8/1995 Campbell ..... 224/405
5,507,237 A * 4/1996 Barrow et al. ..... 108/55.1
5,533,456 A * 7/1996 Regina ..... 108/57.29
5,582,495 A * 12/1996 Schroeder ..... 410/32
5,597,113 A 1/1997 Bradford
5,603,419 A 2/1997 Peterson
5,644,992 A * 7/1997 Clive-Smith ..... 108/55.1
5,671,854 A * 9/1997 Thomas ..... 220/1.5
5,692,625 A * 12/1997 Filipescu et al. ..... 211/195
5,725,118 A 3/1998 Slager
5,746,341 A * 5/1998 Olson ..... 220/6
5,755,472 A * 5/1998 Clive-Smith ..... 294/67.1
5,813,566 A 9/1998 Bradford
5,924,577 A * 7/1999 Gessert ..... 211/41.1
5,941,398 A * 8/1999 Harris ..... 211/60.1
6,062,410 A 5/2000 Bradford
6,073,786 A * 6/2000 McCorkle, Jr. ..... 211/187
6,123,208 A * 9/2000 Haenszel ..... 211/175
6,146,068 A * 11/2000 Schroeder ..... 410/35
6,202,569 B1 3/2001 Bailey
6,230,916 B1 5/2001 Bradford
6,279,763 B1 * 8/2001 Bush ..... 211/195
6,325,224 B1 12/2001 Brown
6,464,092 B1 * 10/2002 Kortman et al. ..... 211/194
6,497,542 B1 12/2002 Vermeulen
6,513,442 B1 2/2003 Miller
6,540,096 B1 4/2003 Bazany
6,585,126 B1 * 7/2003 Grigsby et al. ..... 220/6
6,601,928 B1 * 8/2003 Kortman et al. ..... 312/3
6,679,378 B1 1/2004 Vermeulen
6,691,885 B2 * 2/2004 Brown ..... 220/7
6,968,962 B2 * 11/2005 Toma ..... 211/182
7,001,130 B2 * 2/2006 Ransom ..... 414/416.08
7,044,065 B2 * 5/2006 Arai et al. ..... 108/53.1
7,125,212 B2 * 10/2006 Moore et al. ..... 410/46
7,131,803 B2 * 11/2006 Guarisco et al. ..... 410/35
7,270,236 B2 * 9/2007 Angeletti et al. ..... 206/448
7,293,946 B1 * 11/2007 Fuller ..... 410/43
7,328,804 B2 * 2/2008 Andre et al. ..... 206/600
7,438,195 B2 * 10/2008 Beck ..... 211/194
7,491,024 B2 * 2/2009 Heinrichs et al. ..... 410/32
2003/0164318 A1 * 9/2003 Lacasse et al. ..... 206/448
2004/0168946 A1 * 9/2004 Angeletti et al. ..... 206/448
2004/0232146 A1 * 11/2004 Kessler et al. ..... 220/6
2006/0138067 A1 * 6/2006 Tourlamain ..... 211/195
2007/0108203 A1 * 5/2007 Vroon ..... 220/1.5

* cited by examiner

MODULAR AND CUSTOMIZABLE RETURNABLE RACK SYSTEM

BACKGROUND

Returnable shipping containers or racks often consist of a base or frame, at least four posts or walls extending upwardly from the frame, and integral packing materials ("dunnage") for protecting the rack's cargo or products from damage during transport. After the racks have been used to ship a product, they are returned for reuse. To reuse the racks or containers, they must be built from a sturdy, durable material that will withstand the loads from the products as well as the loads from other racks and containers being stacked on top for shipment or storage.

Moreover, to reduce the shipping costs for both product shipment and return of the racks, the racks should incorporate modular standard footprints and load heights allowing for efficient ship densities. Racks should also be stackable in the configuration used for product shipment and return of the racks. Stacking the racks maximizes the space used in transport containers and reduces overall shipping costs.

Returnable racks are typically uniquely designed for each application (i.e. "customized"), placed into service, and then discarded at the end of their intended use. Discarding customized racks is wasteful and inefficient. With the majority of the rack cost contained in the base and end posts, it is cost-effective to reuse the base when building a customized rack. Moreover, integrating new dunnage systems into existing rack bases decreases the costs associated with building a customized rack solution while maintaining the standard modular footprints and design features.

Shipping racks are often designed for use with many different types of dunnage structures and products, and the racks can therefore be used numerous times before being discarded. For instance, the same rack may be configured to receive both instrument panels and windshields depending upon the dunnage design. Therefore, reconfiguring the dunnage on the racks when the rack needs windshield dunnage, rather than instrument panel dunnage, results in a more efficient use of the racks.

Thus, it is desired to have a customizable reusable, stackable rack or container system that optimizes inbound/outboard shipping densities, maximizes asset utilization, and reduces material waste.

SUMMARY

A modular, customizable returnable rack system for shipping products is provided. The system includes a plurality of racks, wherein each rack is selectively displaceable between a collapsed position and an upright position. The racks are adapted to be stacked upon one another in either the collapsed or upright position. The system further includes a first removable dunnage structure couplable to a rack and configured to receive a first type of product and a second removable dunnage structure couplable to a rack and configured to receive a second type of product.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
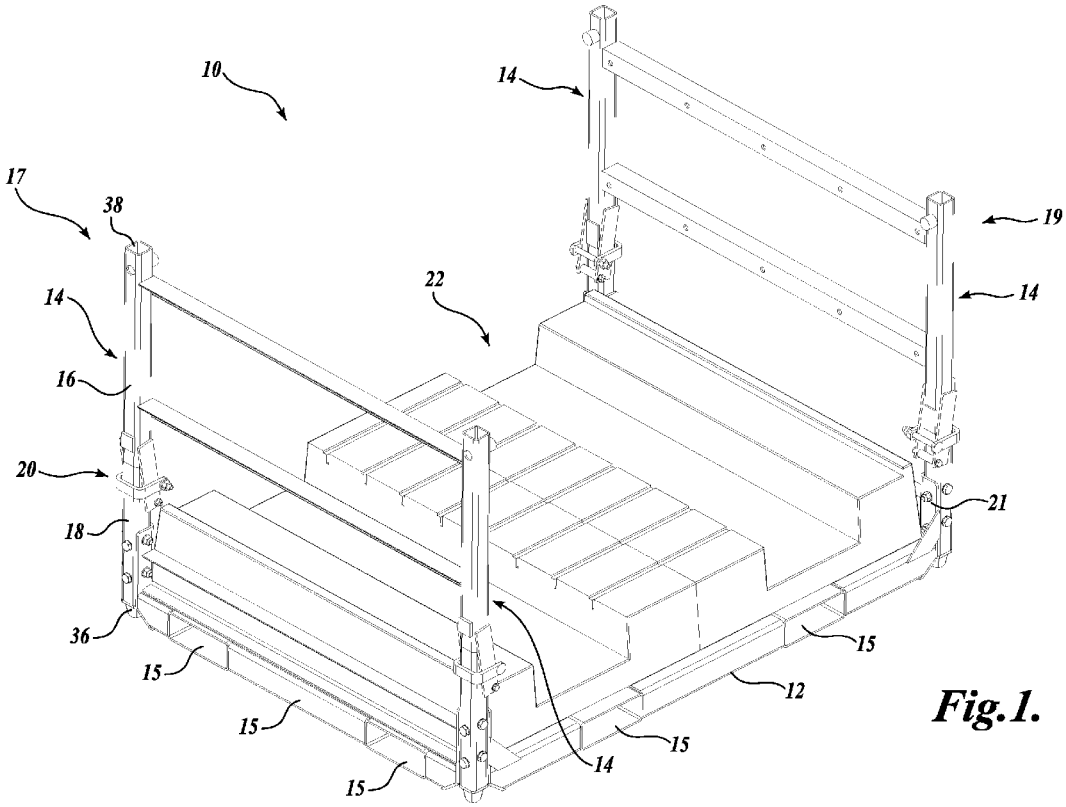
FIG. 1 is an isometric view of a rack for a rack system constructed in accordance with one embodiment of the present disclosure, wherein the rack is in the upright position and the rack has a dunnage structure mounted thereto.

Referring to FIG. 1, a reusable, returnable, customizable container or rack system uses a container, or rack 10 for shipping products thereon. The rack 10 includes a frame 12 of any suitable shape, preferably a generally rectangular or square shape, wherein the frame 12 includes a collapsible post 14 extending upwardly and generally orthogonally from each corner of the frame 12. The frame 12 and posts 14 are formed from any suitable material, such as, but not limited to, steel, aluminum, etc.

Figure 2:
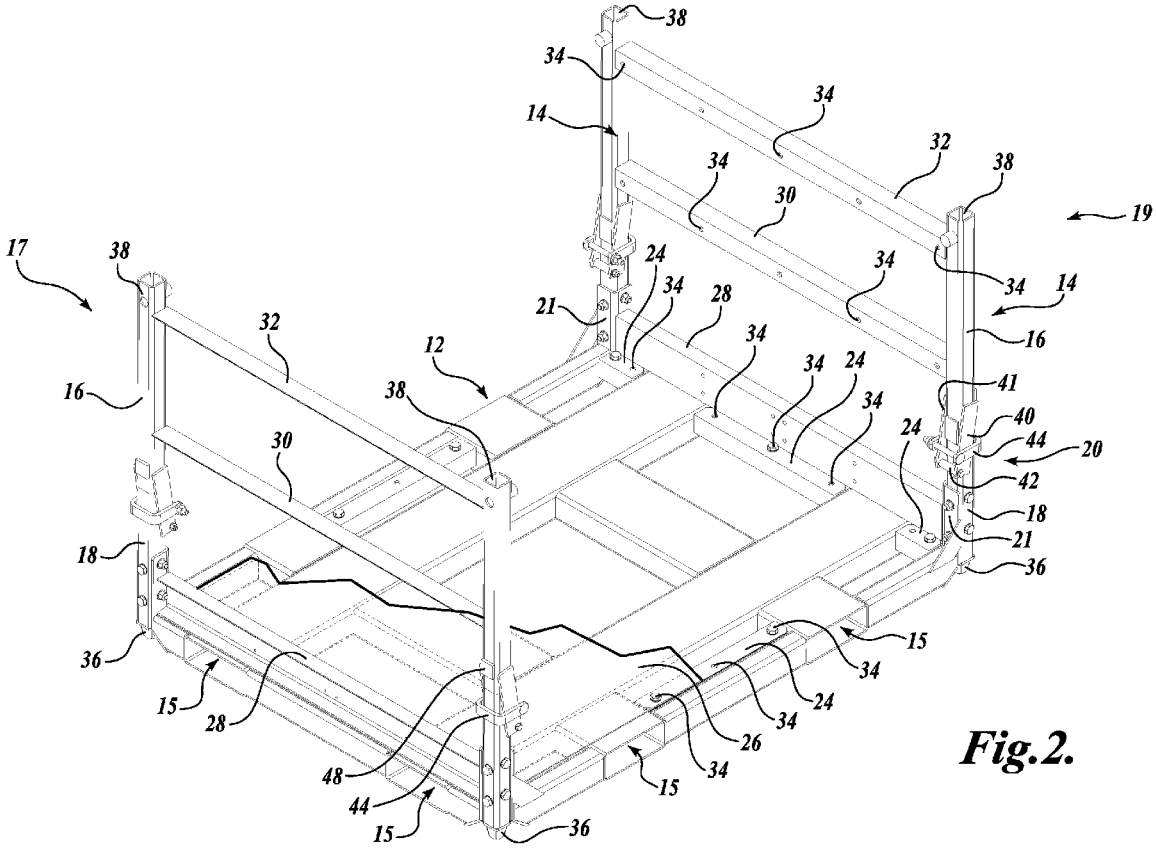
FIG. 2 is an isometric view of the rack of FIG. 1, wherein the dunnage structure has been removed.

Referring to FIG. 2, the frame 12 may be any suitable design, such as a well-known bridge style frame or a low profile tube frame. The frame 12 is depicted having a low profile tube design; however, it should be appreciated that any suitable frame design may be used. Preferably, the size, shape, and design of the frame conform to well-known standards in the shipping industry such that the racks 10 may be used as drop-in replacements for existing racks and rack systems. Multiple openings 15 are formed on each side of the frame 12 for receiving the forks of a forklift (not shown) or the lifting means of another lifting machine. Ideally, the space between the openings 15 and the size of the openings 15 also conform to well-known shipping standards such that standard lift forks can be used to lift and move the racks 10. The frame 12 also includes an optional plate or covering 26 (partially shown) that spans across the top surface of the frame 12 to create an even, closed surface on which to support a product.

The frame 12 includes post mounting brackets 21 coupled to the corners of the frame 12. The post mounting brackets 21 are preferably L-shaped in cross section and are received within similarly-shaped recesses formed within each corner of the frame 12. The post mounting brackets 21 are secured to the frame in any suitable manner, such as by welding, with fasteners, etc. A post 14 that is preferably quadrangular-shaped in cross section is received within each recess defined by the L-shaped post mounting bracket 21 so that the posts 14 extend upwardly and generally orthogonally from each corner of the frame 12. The posts 14 are preferably removably secured within the brackets 21 with any suitable fastening means, such as screws or bolts. It should be appreciated that the posts 14 may be removably received within the corners of the frame 12 in any other suitable manner without departing from the scope of the present disclosure.

The four posts 14 are preferably separated into first and second pairs 17 and 19. If the frame 12 is rectangular-shaped, the first pair 17 is located at the first short end of the frame 12, and the second pair 19 is located at the second short end of the frame 12. The rack 10 optionally includes two end frame members 28 that are mounted to the frame 12 near the lower ends of posts 14, with one end frame member 28 extending between the first pair of posts 17, and the other end frame member 28 extending between the second pair of posts 19. Optional first and second cross brackets 30 and 32 also extend between the first pair of posts 17 and between the second pair of posts 19 above end frame members 28. As such, the posts 14 in the first pair 17 are rigidly coupled together, and the posts 14 in the second pair 19 are rigidly coupled together.

Referring back to FIG. 1, a suitable dunnage structure 22 is removably mounted to the frame 12. As shown in FIG. 2, the frame 12 includes a plurality of dunnage mounting portions 24 formed within the frame 12. The dunnage mounting portions 24 may consist of a portion of the frame 12, or may instead consist of separately mounted members secured within the frame 12. For instance, the dunnage mounting portion 24 may be a bracket or other sheet metal element secured to the frame 12. Each dunnage mounting portion 24 includes a plurality of openings 34, preferably threaded, for receiving fasteners. In this manner, a plurality of fasteners (not shown) may be passed through a portion of the dunnage structure 22 and received within the openings 34 in the dunnage mounting portions 24 to removably couple the dunnage structure 22 to the frame 12.

The end frame members 28 and the cross brackets 30 and 32 may also include openings 34 for receiving fasteners. In this manner, a large dunnage structure may not only be removably coupled on its bottom surface to the frame 12, but it may also be removably mounted on its sides to the end frame members 28 and the first and second cross bracket 30 and 32. It should be appreciated that a dunnage structure may instead be removably mounted to the rack 10 in a variety of different ways without departing from the spirit and scope of the present disclosure. For instance, the dunnage structure 22 may also be removably mounted to the posts 14 and the post mounting brackets 21.

Any suitable dunnage structure 22 may be used with the rack 10. The dunnage structure 22 may be formed in any suitable shape and size so as to receive and support the product(s) to be shipped. The dunnage structure 22 may be formed from foam, plastic, cardboard, or another suitable material. The dunnage structure 22 is mounted to the rack 10 with suitable fasteners or in any manner that allows for removal of the dunnage structure 22 when it is no longer needed or a different type of dunnage structure 22 needs to be mounted to the rack 10.

Figure 4:
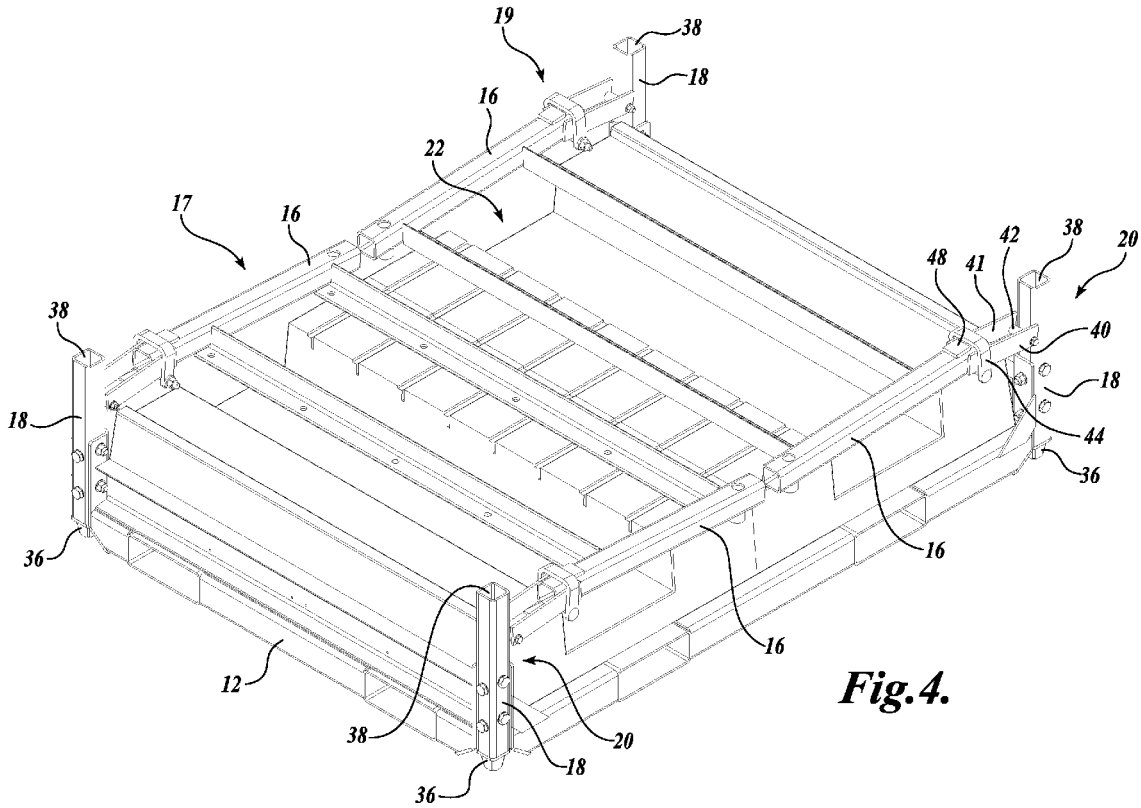
FIG. 4 is an isometric view of a rack in the collapsed position.

Still referring to FIG. 2, each post 14 includes an upper post segment 16 hingedly coupled to a lower post segment 18 via a hinge 20 or similar mechanism. The hinge 20 allows the upper post segment 16 to be reciprocated between an upright position, as shown in FIG. 2, and a collapsed position, as shown in FIG. 4. The hinge 20 includes first and second collars 40 and 41 mounted at their lower ends to a pivot pin 42 and at their upper ends to the upper post segment 16. The pivot pin 42 is pivotally mounted to the outer surface of the lower post segment 18, and the pivot pin 42 is positioned transverse to the post 14. The upper post segment 16 and the collars 40 and 41 are pivotable about the axis defined by the pivot pin 42.

The hinge 20 further includes a ring 44 that is slidably received on the post 14 and encircles the post 14 and the first and second collars 40 and 41. The ring 44 is sized such that it is prevented from sliding over the collars 40 and 41 at the bottom end of the collars near the pivot pin 42. A bumper 48 is secured to the outer surface of the upper post segment 16 between the upper ends of the collars 40 and 41. The bumper 48 is sized such that the ring 44 cannot slide on the post 14 over the bumper 48 (see FIG. 4). Accordingly, the ring 44 is slidably maintained over the first and second collars 40 and 41 on the post 14.

The posts 14 are moved between the upright and collapsed position by moving the upper post segment 16 about the pivot pin 42. Referring to FIG. 4, the posts 14 are moved into the collapsed position by first sliding the ring 44 upwardly until it encircles only the upper post segment 16. With the ring 44 held in this position, the upper post segment 16 and collars 40 and 41 can be moved about the axis defined by the pivot pin 42. If a dunnage structure 22 is mounted to the rack 10 when the posts 14 are to be collapsed, the posts 14 may either collapse over the dunnage structure 22, as shown in FIG. 4, or may instead collapse with the dunnage structure (not shown) if the dunnage structure is taller.

To move the posts 14 into the upright position, the upper post segment 16 is moved about the pivot pin 42 until it substantially aligns the lower post segment 18, as shown in FIG. 1. Thereafter, the ring 44 is slide downwardly along the post 14 until it is tightly received around the collars 40 and 41 at the bottom end of the collars near the pivot pin 42. In this position, the ring 44 substantially prevents the collars 40 and 41 and the upper post segment 16 from moving, thereby retaining the post 14 in the upright position.

Figure 3:
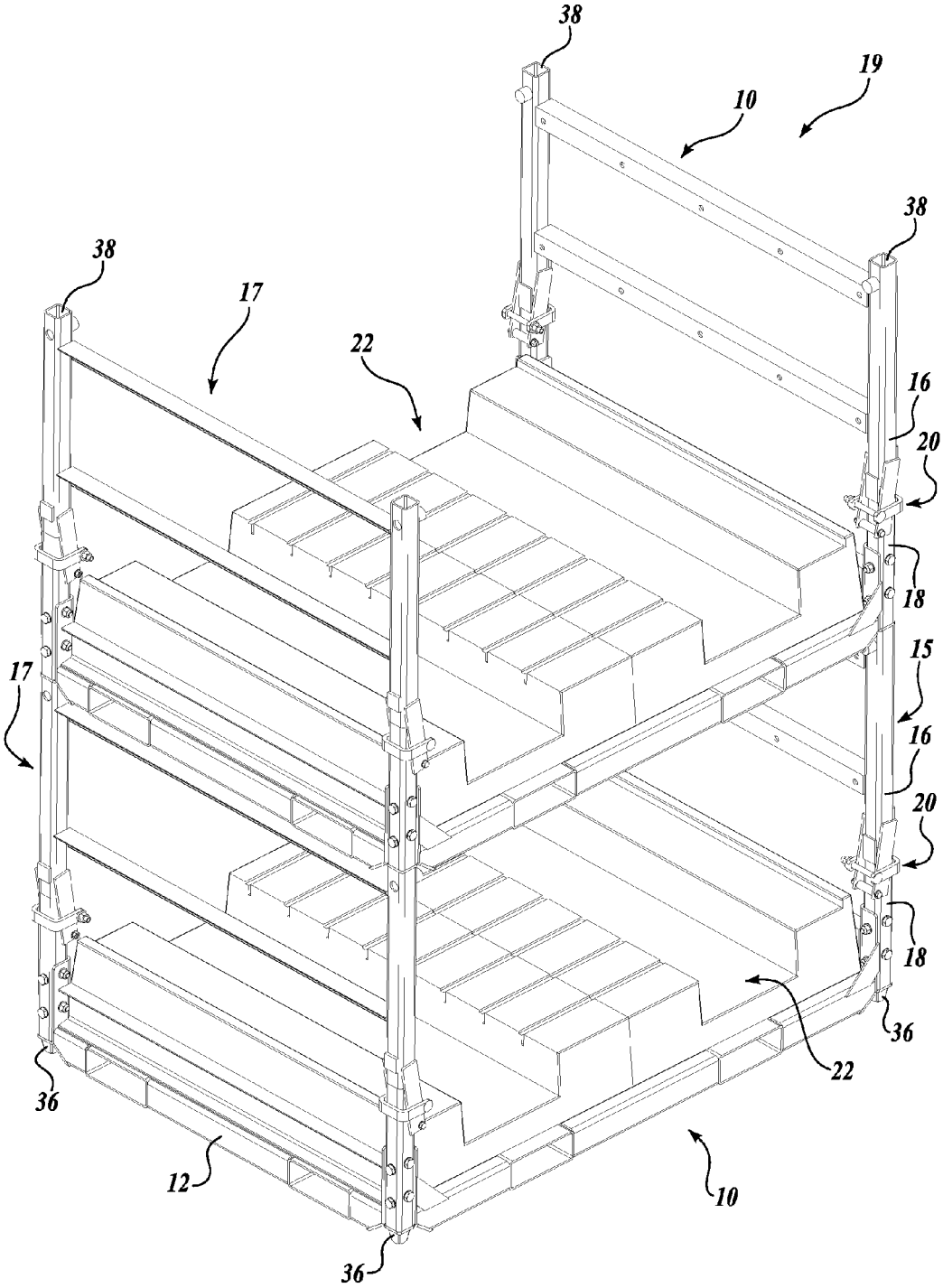
FIG. 3 is an isometric view of first and second racks in the upright position and stacked in a vertical fashion.

To conserve space during shipment and storage, the racks 10 are stackable in either the upright or collapsed position. To facilitate secure stacking of the racks 10 in the upright position, the lower post segments 18 include a male stack plug 36 formed on the lower end of the lower segments 18. The upper post segments 16 include a female stack plug cavity 38 formed within the top end of the upper post segment 16, as shown in FIG. 2. Referring to FIG. 3, to stack the racks 10 on top of one another, the male stack plugs 36 of the lower post segments 18 of a top rack 10 are received within the female stack plug cavities 38 of the upper post segments 16 of a bottom rack 10. Multiple other racks can be stacked upon the top and bottom upright racks in a similar manner.

Figure 5:
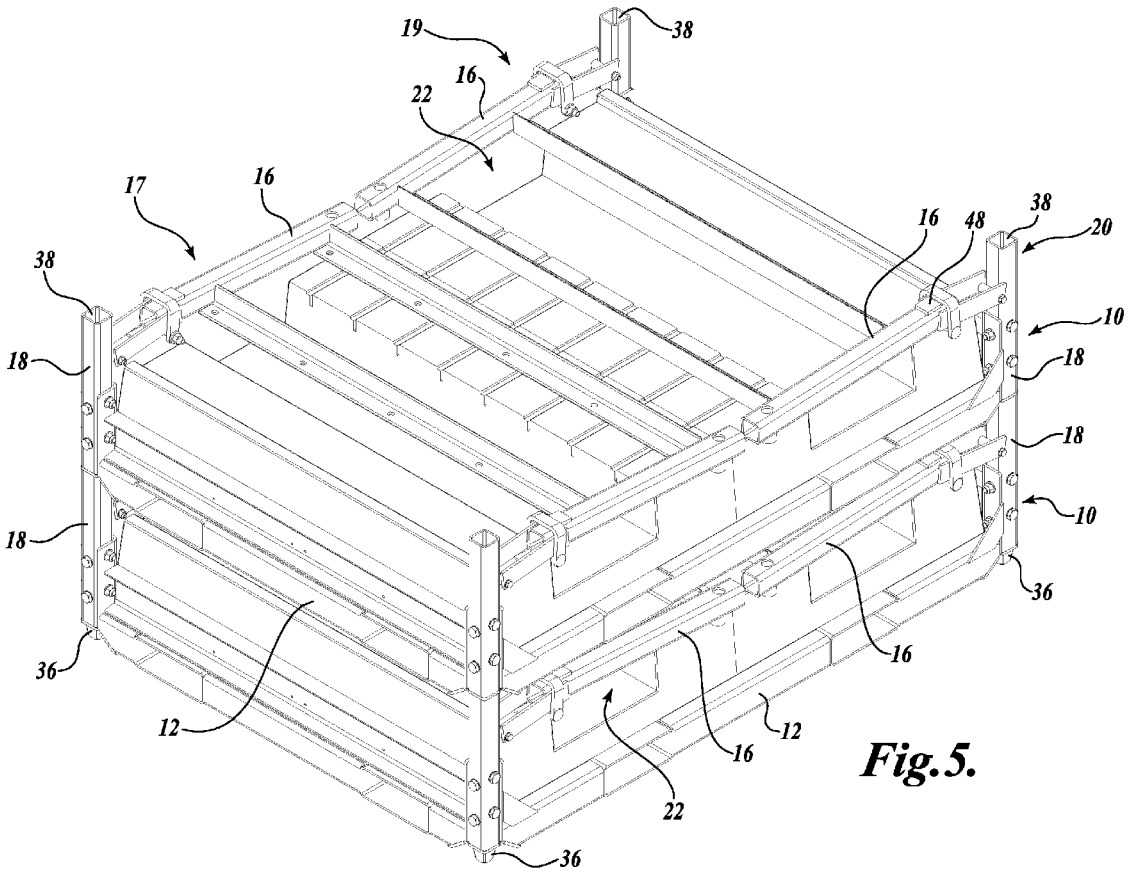
FIG. 5 is an isometric view of first and second racks in the collapsed position and stacked in a vertical fashion.

The racks 10 are also stackable in the collapsed position. As shown in FIG. 4, a female stack plug cavity 38 is also formed in the upper end of each lower post segment 18. Referring to FIG. 5, with the posts 14 in the collapsed position, the male stack plugs 36 of the lower post segments 18 of a top rack 10 are received within the female stack plug cavities 38 in the upper end of the lower post segments 18 of a bottom rack 10. Multiple other racks can be stacked upon the top and bottom collapsed racks in a similar manner.

The customizable, reusable, returnable rack system includes first customizing the rack 10 for shipment of a certain type of product. To ship a first type of product, a first suitable dunnage structure 22 is mounted on a first rack 10 for receiving, supporting and protecting the first type of product during shipment on the first rack 10. The posts 14 are moved into the upright position, and a product is secured on the first rack 10. Other racks 10 with similar or different products may be stacked below or on top of the first rack 10 when positioned within a larger shipping container or transport device.

Once the product has been delivered, the first rack 10 can be collapsed for return shipment. The posts 14 of the first rack 10 and the other racks 10 are moved into the collapsed position such that the racks 10 may be stacked upon one another within the transport device. This maximizes use of the transport device or shipping container, thereby reducing overall shipping costs and making reuse of the racks cost effective. It should also be appreciated that instead of collapsing the posts 14, the posts 14 may be removed from the frame 12 such that only the frame 12 is returned for reuse or such that they are returned separately.

Each rack 10 having a certain type of dunnage structure 22 is reused for shipping a certain type of product until that type of product is no longer to be shipped (i.e., for the life of the product). For instance, a rack 10 having a first dunnage structure 22 may be used for shipment of a first type of product for the life of the first type of product. The first dunnage structure 22 remains on the rack 10 until the rack is no longer being used for shipment of the first type of product. When it is desired to use the rack 10 for shipment of a second type of product, the first dunnage structure 22 is removed from the rack 10 and a second dunnage structure 22 is mounted thereon. This cycle may continue for the entire life of the rack 10.

While illustrative embodiments have been illustrated and described, it will be appreciated that various changes can be made therein without departing from the spirit and scope of the present disclosure.

The embodiments of the invention in which an exclusive property or privilege is claimed are defined as follows:

1. A customizable rack configured to received a removable dunnage structure, the rack comprising:

(a) a base for supporting products thereon, the base having a shape to define four base corners, the base formed at least in part by a first pair of cross tubes positioned substantially transversely to a second pair of cross tubes, wherein end openings of the cross tubes are sized and configured to receive portions of a lifting apparatus, the first and second pair of cross tubes defining a base bottom surface;

(b) a plurality of dunnage mounting portions coupled to the first and second pairs of cross tubes, each dunnage mounting portion including a plurality of openings configured to receive fastening elements of a removable dunnage structure;

(c) a corner recess formed within each base corner;

(d) a substantially L-shaped post-mounting bracket secured within each corner recess, the post-mounting bracket defining a substantially L-shaped corner recess; and (e) a post received within each L-shaped corner recess and removably coupled to the corresponding L-shaped post mounting bracket, each post having a lower post segment and an upper post segment hingedly coupled thereto, the lower post segment including a stack plug cavity formed in its upper end and a stack plug formed on its lower end that is positioned above a base bottom surface when the post is coupled to the L-shaped post mounting bracket, the upper post segment including a stack plug cavity formed in its upper end that is adapted to receive the stack plug formed in the lower end of a lower post segment of another rack, the posts being selectively translatable between at least an upright position and a collapsed position, wherein a collapsed rack may be stacked upon another collapsed rack such that the stack plug formed in the lower end of a lower post segment of one rack is received within the stack plug cavity formed in the upper end of a lower post segment of another rack.

2. The rack of claim 1, wherein each post is removably secured to each corresponding L-shaped bracket with a plurality of fasteners.

3. The rack of claim 1, wherein each post is removably secured to each corresponding L-shaped bracket with first and second pairs of fasteners, and wherein the first pair of fasteners are positioned within the post substantially transversely to the second pair of fasteners.

4. The rack of claim 1, wherein the openings formed in the dunnage mounting portions are threaded openings.

5. The rack of claim 1, wherein the dunnage mounting portions are configured to secure one of a plurality of removable dunnage structures to the rack for shipment of corresponding type of product.

6. The rack of claim 1, further comprising a removable dunnage structure secured to the dunnage mounting portions.

7. The rack of claim 6, wherein the removable dunnage structure is secured within the rack when the rack is collapsed.

* * * * *